US006206117B1

(12) United States Patent
Tibbitts et al.

(10) Patent No.: US 6,206,117 B1
(45) Date of Patent: Mar. 27, 2001

(54) DRILLING STRUCTURE WITH NON-AXIAL GAGE

(75) Inventors: Gordon A. Tibbitts, Salt Lake City; James A. Norris, Sandy, both of UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/364,800

(22) Filed: Jul. 30, 1999

Related U.S. Application Data

(63) Continuation-in-part of application No. 08/832,051, filed on Apr. 2, 1997, now Pat. No. 6,123,160.

(51) Int. Cl.[7] ..... E21B 10/46
(52) U.S. Cl. ..... 175/399; 175/408
(58) Field of Search ..... 175/406, 408, 175/399, 398

(56) References Cited

U.S. PATENT DOCUMENTS

| | | | | |
|---|---|---|---|---|
| 1,084,871 | | 1/1914 | Tuck . | |
| 1,547,459 | | 7/1925 | Stafford et al. . | |
| 1,701,427 | | 2/1929 | Shields . | |
| 1,907,154 | | 2/1933 | Mitchell . | |
| 2,249,732 | * | 7/1941 | Green | 175/408 |
| 2,738,167 | | 3/1956 | Williams, Jr. . | |
| 2,838,286 | | 6/1958 | Austin . | |
| 3,135,341 | | 6/1964 | Ritter . | |
| 3,220,497 | | 11/1965 | Mori . | |
| 3,367,430 | | 2/1968 | Rowley . | |
| 3,825,083 | | 7/1974 | Flarity et al. . | |
| 3,851,719 | * | 12/1974 | Thompson et al. | 175/406 |
| 3,945,447 | | 3/1976 | Peterson . | |
| 4,031,974 | | 6/1977 | Peterson . | |
| 4,091,884 | | 5/1978 | Thomas . | |
| 4,098,363 | | 7/1978 | Rohde et al. . | |
| 4,106,578 | * | 8/1978 | Beyer | 175/407 |
| 4,234,048 | | 11/1980 | Rowley . | |
| 4,351,401 | | 9/1982 | Fielder . | |
| 4,352,400 | | 10/1982 | Grappendorf et al. . | |
| 4,512,426 | | 4/1985 | Bidegaray . | |
| 4,515,226 | | 5/1985 | Mengel et al. . | |
| 4,515,227 | | 5/1985 | Cerkovnik . | |
| 4,550,790 | | 11/1985 | Link . | |
| 4,552,231 | | 11/1985 | Pay et al. . | |
| 4,586,574 | | 5/1986 | Grappendorf . | |
| 4,635,738 | | 1/1987 | Schillinger et al. . | |
| 4,848,489 | | 7/1989 | Deane . | |
| 4,848,491 | | 7/1989 | Burridge et al. . | |
| 4,869,330 | | 9/1989 | Tibbitts . | |
| 4,981,183 | | 1/1991 | Tibbitts . | |
| 4,986,375 | | 1/1991 | Maher . | |
| 5,004,057 | | 4/1991 | Tibbitts et al. . | |

(List continued on next page.)

FOREIGN PATENT DOCUMENTS

| | | |
|---|---|---|
| 1196765 | 7/1970 | (GB) . |
| 994677 | 2/1983 | (SU) . |

OTHER PUBLICATIONS

Description of Norton Christensen drill bits—early 1980's (5 pages).

*Primary Examiner*—Hoang Dang
(74) *Attorney, Agent, or Firm*—Trask Britt

(57) ABSTRACT

A drill bit and method of drilling a subterranean formation are disclosed in which the drill bit is configured with a non-axial gage portion of a bit body. The non-axial gage portion of the bit body presents a peripheral profile which is not parallel to the centerline of the bit body to provide a contact area for engagement of the sidewall of the borehole by at least one cutting element carried by the non-axial gage portion to enlarge the borehole from a first diameter cut by cutting elements on the bit face. The configuration of the drill bit lessens loading on the cutting elements of the drill bit, facilitates maneuverability of the drill bit downhole and enhances steerability of the drill bit.

40 Claims, 7 Drawing Sheets

U.S. PATENT DOCUMENTS

| | | | | |
|---|---|---|---|---|
| 5,163,524 | | 11/1992 | Newton, Jr. et al. . | |
| 5,178,222 | | 1/1993 | Jones et al. . | |
| 5,314,033 | | 5/1994 | Tibbitts . | |
| 5,341,888 | | 8/1994 | Deschutter . | |
| 5,361,859 | | 11/1994 | Tibbitts . | |
| 5,425,288 | | 6/1995 | Evans . | |
| 5,433,280 | | 7/1995 | Smith . | |
| 5,456,328 | | 10/1995 | Saxman . | |
| 5,467,836 | | 11/1995 | Grimes et al. . | |
| 5,495,899 | | 3/1996 | Pastusek et al. . | |
| 5,641,027 | | 6/1997 | Foster . | |
| 5,678,644 | | 10/1997 | Fielder . | |
| 5,697,461 | | 12/1997 | Newton et al. . | |
| 5,967,247 | * | 10/1999 | Pessier | 175/408 |
| 6,112,836 | * | 9/2000 | Spaar et al. | 175/406 |
| 6,123,160 | * | 9/2000 | Tibbitts | 175/385 |

* cited by examiner

DRILLING STRUCTURE WITH NON-AXIAL GAGE

CROSS REFERENCE TO RELATED APPLICATION

This application is a continuation-in-part of U.S. patent application Ser. No. 08/832,051, now U.S. Pat. No. 6,123,160 filed Apr. 2, 1997.

BACKGROUND OF THE INVENTION

1. Field of the Invention

This invention relates generally to rotary drill bits used in drilling subterranean boreholes and, more specifically, to drilling structures having at least one gage portion or region which provides expansion of the diameter of a borehole beyond that drilled by cutters on the face of a drill bit to reduce loading on the cutters of the bit and to facilitate maneuvering of the drill bit down hole.

2. State of the Art

The equipment used in subterranean drilling operations is well known in the art and generally comprises a drill bit attached to a drill string, including a drill pipe and one or more drill collars. A rotary table or other device such as a top drive is used to rotate the drill string, resulting in a corresponding rotation of the drill bit. The drill collars, which are heavier per unit length than drill pipe, are normally used on the bottom part of the drill string to add weight to the drill bit, increasing weight on bit (WOB). The weight of these drill collars presses the drill bit against the formation at the bottom of the borehole, causing it to engage the formation and drill when rotated. Downhole motors are also normally employed in the drilling of directional or oriented boreholes, in which case the bit is secured to the output or drive shaft of the motor.

A typical rotary drill bit includes a bit body with a structure for connecting the bit body to the drill string, such as a threaded portion on a shank extending from the bit body, and a crown comprising that part of the bit fitted with cutting structures for cutting into a subterranean formation. Generally, if the bit is a fixed-cutter or so-called "drag" bit, the cutting structures include a series of cutting elements (also termed cutters) made of a superabrasive material, such as polycrystalline diamond, oriented on the bit face at an angle to the surface being cut (i.e., side rake, back rake).

Various manufacturing techniques known in the art are used for making a drill bit. In general, the bit body may typically be formed from a cast or machined steel mass, or comprise a tungsten carbide matrix cast by infiltration in a mold cavity with a liquified metal binder and secured thereby to a blank extending into the matrix, the blank being subsequently welded to a tubular shank. Threads are then formed onto the free end of the shank to correspondingly match the threads of a drill collar.

Cutting elements are usually secured to the bit by preliminary bonding to a carrier element, such as a stud, post or elongated cylinder, which, in turn, is inserted into a pocket, socket or other aperture in the crown of the bit and mechanically or metallurgically secured thereto. Specifically, polycrystalline diamond compact (PDC) cutting elements, usually of a circular or disc-shape comprising a diamond table bonded to a supporting WC substrate, may be brazed to a matrix-type bit after furnacing. Alternatively, freestanding (unsupported), metal-coated, thermally stable PDCs (commonly termed TSPs) may be bonded into the bit body during the furnacing process used to fabricate a matrix-type drill bit. Natural diamonds may also be used as cutters and, as with TSPs, bonded into a bit body.

The direction of the loading applied to the radially outermost (i.e., gage) cutters in conventional drill bits is primarily lateral. Such loading is thus tangential in nature, as opposed to the force on the cutters on the face of the bit, which is substantially provided by the WOB and thus comprises a normal force substantially in alignment with the longitudinal axis of the bit. The tangential forces tend to unduly stress even those cutters specifically designed to accommodate this type of loading because of the stress concentrations experienced by the relatively small number of cutters assigned the task of cutting the gage diameter. It should be realized that, for any given rotational speed of a bit, the cutters proximate the gage area of the bit are traveling at the highest velocities of any cutters on the bit due to their location at the largest radii of the bit. Such cutters also traverse the longest distances during operation of the bit. Therefore, their velocity, plus their distance traveled and the large sideways or lateral resistive loads encountered by the cutters, may overwhelm even the most robust state-of-the-art superabrasive PDC cutters. The radially outermost cutters on the bit face, referred to as gage cutters, typically have a flattened or linear radially outer profile aligned parallel to the longitudinal axis of the bit to reduce cutter exposure and to cut a precise gage diameter through the borehole. Such profiles, unfortunately, actually enhance or accelerate wear in the cutters due to the large contact areas of the cutters with the formation, which generate excessive heat. Wear of the gage cutters may, over time, result in an undergage wellbore.

In a conventional bit arrangement, the gage of the bit is that substantially cylindrical portion located adjacent to and extending above the gage cutters longitudinally along the bit body at a given, fixed radius from the bit centerline, the gage of the bit body being parallel to the bit centerline. In a slick gage arrangement, for example, such as that disclosed in U.S. Pat. No. 5,178,222, the radius of the gage is essentially the same as the outer diameter defined by the gage cutters. During drilling, as the bit penetrates into a formation, a typical drill bit will drill the borehole diameter with the gage cutters. The gage of the bit then snugly passes through the borehole. Even when the gage cutters extend a substantial radial distance from the centerline beyond the gage of the bit, as the gage cutters wear and the diameter of the wellbore consequently decreases to become closer to that of the bit gage, greater frictional resistance by the gage against the wall of the wellbore is experienced. As a result, the rate of penetration (ROP) of the drill bit will continually decrease, requiring application of increasing torque to the bit until the gage cutters degrade to a point where the ROP is unacceptable. At that point, the worn bit must be tripped out of the borehole and replaced with a new one, even though the face cutting structure may be relatively unworn.

These problems are somewhat addressed by, for example, providing cutting elements on the gage of the bit to lengthen the life of the drill bit. For example, U.S. Pat. No. 5,467,836 discloses a drill bit having gage inserts that provide an active cutting gage surface which engages the sidewall of the borehole to promote shearing removal of the borehole sidewall material. U.S. Pat. No. 5,004,057 illustrates a drill bit having both an upper and lower gage section having gage cutting portions located thereon. Other prior art bits include both abrasion-resistant pads and cutters on the gage of the bit, such as the bit disclosed in U.S. Pat. No. 5,163,524. An approach to providing an increased enlargement of the borehole is disclosed, for example, in U.S. Pat. No. 3,367, 430 and U.S. Pat. No. 5,678,644, each of which describes an upper eccentric gage portion which cuts a larger portion of the formation above a lower gage portion of the drill bit. Neither design, however, is structured for reducing cutting loads on the gage cutters, nor do they provide an increase in the borehole diameter immediately above the gage cutters.

Recognizing that conventional bit body designs may place the gage cutters in a position on the bit which leads to early bit failure, and further recognizing that the design of the typical bit gage makes it difficult to maneuver the bit downhole once the gage cutters are worn, it would be advantageous to provide a drill bit which is configured to provide a slight enlargement of the borehole diameter to lessen the loads on the gage cutters and to facilitate maneuvering of the drill bit downhole.

BRIEF SUMMARY OF THE INVENTION

In accordance with the present invention, a rotary-type drill bit is configured with at least one gage region which is in non-axial orientation to the longitudinal axis or centerline of the bit body to produce a shallow engagement of the formation by the cutting elements associated with the gage region of the bit body to produce a slight enlargement of the borehole, thereby advantageously modifying the cutting loads on the gage cutter elements of the drill bit and facilitating the maneuvering of the drill bit downhole. The present invention also enhances the steerability of the drill bit downhole by facilitating cutting a slightly enlarged borehole, enhancing side cutting during turns, and reducing ledging on the sidewall of the borehole. In addition, the inventive bit structure has utility in drilling sloughing and expanding formations, and may facilitate re-entry into previously-drilled boreholes. Further, the inventive gage design may be used to provide a larger bearing area for the gage region of the bit, reducing loading on the gage. Finally, the use of a single, non-parallel gage region, according to the present invention, may facilitate passage of a bit through a non-linear borehole segment by aligning the gage section with the direction of the turn.

The drill bit of the present invention is configured with a shank for attachment of the drill bit to a drill pipe and a crown to which is attached a plurality of cutting elements oriented to contact the formation for cutting. More specifically, the crown of the bit body is comprised of a face portion bearing at least one cutting element oriented to engage the formation being drilled to form a borehole of a first diameter and a non-axial gage portion bearing at least one cutting element for enlarging the first diameter of the borehole in accordance with one aspect of the invention. The face portion of the bit body may further include a gage definition region having at least one cutting element for cutting the diameter of the borehole. The cutting elements in the gage definition region may generally be arranged to gradually expand the diameter of the borehole being cut relative to that area of the borehole being cut by the face cutters. Preferably, the diameter of the bit in the gage definition region is smallest at the leading end of the bit and gradually increases in diameter from one cutting element to the next.

The non-axial gage portion of the drill bit of the present invention is that portion positioned adjacent to and above the face portion of the bit body, extending toward the shank of the bit body. As used herein, "non-axial" means that the peripheral profile of the gage portion lies in non-parallel relationship to the longitudinal axis or centerline of the bit body, in contrast to the gages of conventional drill bits. Rather, in the present invention, at least a portion of the gage of the bit is configured to present an outer profile which is out of alignment with the centerline of the bit body to provide modest enlargement of the borehole diameter above the face portion of the bit body, which facilitates maneuverability of the bit downhole, lessens loading on the gage cutters, improves the steerability of the drill bit and enhances the cutting characteristics of the bit in the formation. As noted below, a plurality of such non-axial gage subportions having different rotational alignments about the bit's longitudinal axis may be employed in a vertically superimposed or stacked relationship to form a non-axial gage portion according to the invention.

The non-axial gage portion may comprise one or more protrusions or blades which extend out from the bit body and which provide an exterior surface on which cutting elements or abrasion resistant structures may be attached. The protrusions or blades may be continuous from the face portion to near the shank of the bit body, or they may be discontinuous therefrom. Further, the protrusions or blades may be oriented along the exterior of the bit body in a generally longitudinal direction extending from near the face portion toward the bit shank or, alternatively, the protrusions or blades may be placed at a constant or variable acute angle to the bit centerline, extending in a curved fashion (i.e., substantially helically) from the face portion toward the bit shank and about the bit body. In another embodiment, the non-axial gage portion may be configured as an annular land extending substantially radially from the bit body and providing an exterior surface for attachment of cutting elements oriented to engage the borehole.

Because of the non-axial orientation of the gage portion, not all areas of the nonaxial gage portion will make direct contact with the formation. However, the non-axial configuration of the gage portion results in peripheral regions of the gage portion which extend farther out from the centerline of the bit body than other regions of the gage portion and, hence, provide contact areas which are oriented to engage the side of the borehole. At those contact areas, at least one cutting element is provided to enlarge the diameter of the borehole, as previously described. The cutting element may be of any known and suitable type, including a PDC or TSP cutter. The cutting elements in the gage portion may be arranged at an angle or pitch relative to the centerline of the bit body, preferably corresponding to an angle or pitch or range of angles or pitches which generates a shallow cut or a series of shallow cuts into the sidewall of the borehole as initially drilled. The gage portion may also bear abrasion resistant structures of known types, such as tungsten carbide buttons, wear pads or other inserts, or have its radially exterior surfaces formed of such a material.

In one embodiment of the invention, the non-axial gage portion may extend above the face portion of the bit body toward the bit shank. In a second embodiment, the bit body may comprise a gage region comprising an axial gage portion directly above the face portion which then transitions into a non-axial gage portion which extends toward the bit shank. In a third embodiment of the invention, the bit body may comprise a gage region comprising a non-axial gage portion directly above the face portion which then transitions into an axial gage portion which extends to the bit shank. In each of the described embodiments, an area of the non-axial gage portion is configured and oriented to contact the sidewall of the borehole to modestly enlarge the borehole and to lessen loading on the gage cutters.

In a fourth embodiment of the invention, the non-axial gage portion is comprised of a plurality of non-axially oriented gage subportions, each of which subportions further comprises at least one substantially linear, longitudinally extending protrusion or blade in non-parallel relationship to the centerline of the bit body, and having at least one cutting element positioned at a contact area thereof and oriented to contact the side of the borehole to enlarge the borehole in more than one location. In a similar, but alternative, fifth embodiment of the invention, the non-axial gage portion comprises a plurality of non-axially oriented, longitudinally extending gage subportions, the peripheral profiles of which are non-linear or curved. Each subportion has at least one protrusion or blade bearing at least one cutting element positioned at a contact area thereof for enlargement of the borehole diameter. Of course, axial gage portions alternating with non-axial gage portions may be employed, or multiple, adjacent non-axial gage portions in combination with one or more axial gage portions.

While the present invention is particularly suitable for use with rotary drag bits, it is not so limited. Further, it is specifically contemplated that a sub or other structure incorporating the present invention may be separately fabricated and placed above, and in tandem with, a conventional rotary drag bit or roller cone (also termed "rock") bit. Similarly, the gage of a roller cone bit may be structured in accordance with the present invention.

The invention is also characterized by apparatus and methods of drilling a subterranean formation to a selected diameter with the cutting elements located on the face portion of the bit body and modestly enlarging the diameter of the borehole above the face portion by one or more cutting elements positioned at the non-axial gage portion of the bit body. The foregoing and other objects, features and advantages of the invention will become more readily apparent from the following detailed description of the preferred embodiments.

BRIEF DESCRIPTION OF THE DRAWINGS

In the drawings, which illustrate what is considered to be the best mode for carrying out the invention.

DETAILED DESCRIPTION OF THE PREFERRED EMBODIMENTS

Figure 1:
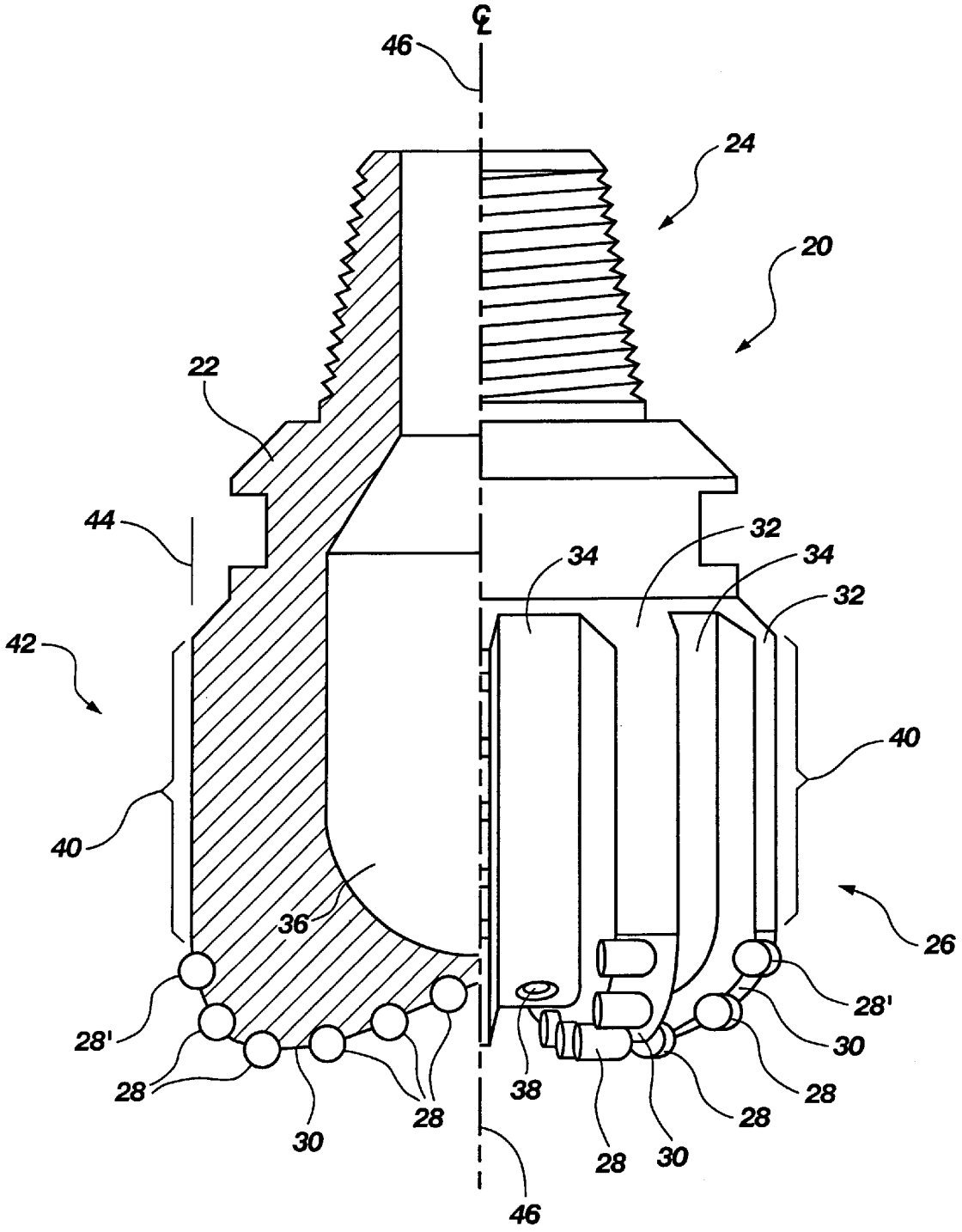
Fig. 1 (PRIOR ART)
FIG. 1 is a view in elevation of a conventional drill bit where the gage portion of the bit presents a peripheral profile which is parallel to the centerline of the drill bit body.

For comparative purposes, FIG. 1 illustrates a conventional type of rotary drill bit 20 comprising a bit body 22 having a shank 24 and a crown 26, which bears cutting elements 28 thereon. The crown 26 of the conventional bit body 20 further comprises a bit face 30 which bears cutting elements 28 oriented to contact and cut the bottom of a subterranean formation. The cutting elements 28 may be borne on blades 32 which extend outwardly from the bit body 22, and spaces formed between the blades 32 define junk slots 34 through which formation cuttings or chips move to exit the borehole. A conventional drill bit 20 may also be configured with an internal plenum 36 through which drilling fluid is pumped from the drill string (not shown). Drilling fluid exits the drill bit 20 through apertures 38 formed through the bit body 22 to help flush the formation chips away.

In conventional drill bits 20 as shown in FIG. 1, the crown 26 may further comprise a gage 40 which extends from the face 30 of the bit body 22 toward the shank 24. The gage 40 typically constitutes the outermost circumference or periphery of the bit body 22. As shown, the peripheral profile 42 of the conventional bit gage 40 lies along the outer envelope 44 of a cylindrical surface of revolution which is parallel to the longitudinal axis or centerline 46 of the bit body 22 and, therefore, the peripheral profile 42 of the conventional bit gage 40 may be considered "axial" by virtue of its parallel alignment. The gage 40 of a conventional drill bit 20 serves to center the drill bit 20 within the borehole and can be selectively configured to influence the steering properties of the drill bit 20.

Conventional drill bits 20 are known to encounter problems downhole, however, when the gage cutters 28' (i.e., the radially outermost cutting elements on the bit face which produce the gage diameter of the borehole) become worn, so that the gage diameter of the borehole essentially equals the diameter of the drill bit 20 measured about the bit gage 40. Thus, due to ever-increasing contact area between the drill bit 20 and the borehole sidewall, drill bit 20 rotates ever more slowly as the gage cutters 28' wear down, requiring application of greater torque to maintain a given rotation speed, until at some point the drill bit will cease to be rotatable within the borehole without significant risk of damage to the drill string. When a downhole motor is used, the motor may simply stall due to excessive resistance to rotation of the bit which the motor's torque carmot overcome. Although not shown in FIG. 1, the blades 32 of the bit gage 40 may bear abrasion resistant elements, such as tungsten carbide inserts, buttons or wear pads, to aid the drill bit 20 in its rotation as the gage cutters 28' wear down.

Figure 2:
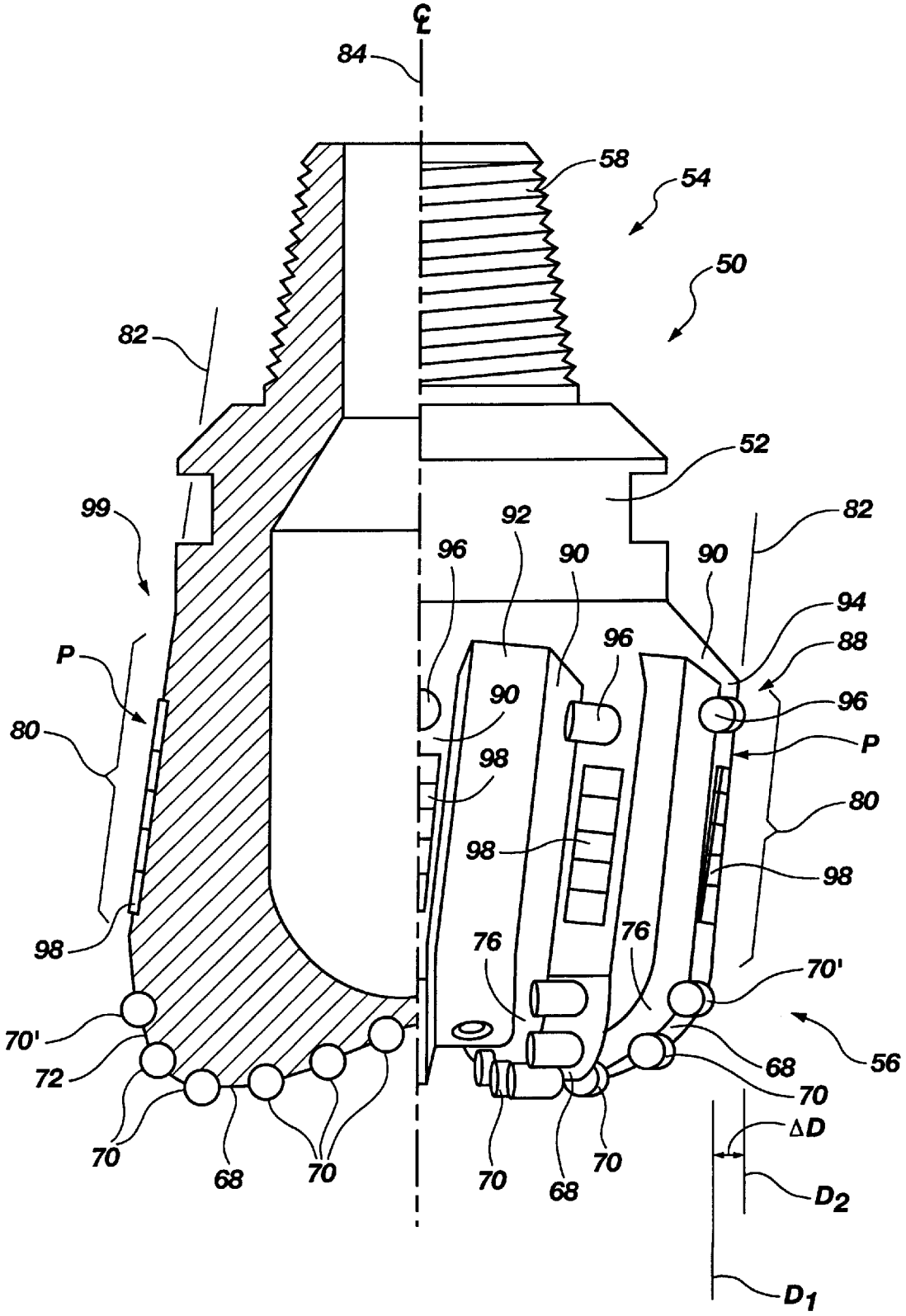
FIG. 2 is a view in elevation of a drill bit incorporating a first embodiment of the invention illustrating a non-axial gage portion.

These problems encountered in conventional drill bits are addressed in the present invention, a first embodiment of which is illustrated in FIG. 2. The drill bit 50 of the first embodiment comprises a bit body 52 having a shank portion 54 and a crown portion 56. The shank portion 54 is configured with apparatus for attaching the drill bit 50 to a drill string (not shown), such as a threaded pin 58. The crown portion 56 of the bit body 52 comprises a face portion 68 which bears at least one cutting element 70 oriented to engage and form the bottom of a borehole. As shown, the face portion 68 may preferably bear a plurality of cutting elements 70. The cutting elements 70 may be of any suitable type or manufacture, including PDC or TSP cutters. The face portion 68 includes a radially outermost portion 72 which bears a number of gage cutters 70' positioned to cut a first gage diameter in the borehole of a radial distance $D_1$. The cutting elements 70 at the face portion 68 of the crown portion 56 of bit body 52 may be positioned on protrusions or blades 76, as shown in FIG. 2, or may be attached to the exterior surface of the crown portion 56 of the drill bit 50 in any other suitable manner.

The bit body 52 of the drill bit 50 is also configured with a non-axial gage portion 80 which is located above the face portion 68 of the crown portion 56 of bit body 52 and extends toward the shank portion 54. The gage portion 80 provides what may generally be considered an outer circumferential or peripheral profile P of the drill bit 50, and the edges of peripheral profile P lie along an orientational line 82 which is not parallel to the centerline 84 of the bit body 52. In some instances, the profile P may be characterized as a substantially cylindrical surface of revolution SR having a centerline or longitudinal axis CL canted or tilted with respect to centerline 84 of bit body 52 (see FIG. 7A), although this is not a requirement of the invention. In other instances, the profile P may, for purposes of visualization, be likened to a stack of extremely thin, circular body sections B (see FIG. 7B, wherein the thickness of sections B is exaggerated for clarity) in the gage region of the bit aligned substantially perpendicular to the centerline 84, each body section B being slightly laterally offset from the next lower body section B, in the manner of a stack of slightly mutually offset coins. As drawn, FIG. 7B depicts a non-axial gage section including two subportions, in the vein of the embodiments of FIGS. 5 and 6, described below. The body sections B may all be offset laterally in the same circumferential direction as shown in FIG. 7B, or some or all of them progressively offset toward slightly different circumferential locations in the same direction as they achieve increasing lateral offsets from the centerline (see FIG. 7C, looking down along centerline 84), in order to achieve a slightly spiraled exterior surface on the non-axial gage portion. Any of the foregoing configurations may be fabricated in a matrix-type drill bit using so-called layered manufacturing technology as disclosed in U.S. Pat. No. 5,433,280 to Smith, the disclosure of which is hereby incorporated herein by this reference. In any case, the non-axial gage portion 80 of the bit body 52 is non-axial due to its non-parallel alignment with the centerline 84 of the bit body 52. It should be noted, with reference to FIGS. 7A through 7C, that the peripheral profile of the non-axial gage portion of whatever configuration may exhibit a substantially constant cross-sectional area transverse to the centerline of the bit body throughout at least a portion of the longitudinal extent of the non-axial gage portion.

The non-axial gage portion 80 of the present invention may be structured in any suitable manner which provides at least one contact area 88 defined by a region of the non-axial gage portion which extends from the centerline 84 a maximum radial distance $D_2$ which is greater than the radial distance $D_1$ at which the gage cutters 70' are located. For example, the non-axial gage portion 80 of the bit body 52 may be structured with protrusions or blades 90 which extend outwardly from an exterior surface 92 of the bit body 52 to form the peripheral profile P of the non-axial gage portion 80. Alternatively, the exterior surface 92 of the bit body 52 may be configured in a manner devoid of blades or similar protrusions, but, because of its non-axial orientation, the non-axial gage portion 80 will still provide a contact area 88, as described.

The drill bit 50 illustrated in FIG. 2 is structured with blades 90 which, in this particular illustration, are continuous with blades 76 extending along the face portion 68. Alternatively, however, blades 90 on the non-axial gage portion 80 may be discontinuous from the blades 76 of the face portion 68. The upper region 94 of a certain number of the blades 90 of the non-axial gage portion 80 which extends outwardly a sufficient distance from the centerline 84 of the bit body 52 forms a contact area 88 of the non-axial gage portion 80 which engages the side of the borehole. At least one cutting element 96 is preferably located in the upper region 94 of each such blade 90 comprising the contact area 88, such contact area 88 being characterized as any portion of the non-axial gage which extends laterally beyond the first diameter of the borehole as cut by cutters 70' located at radial distance $D_1$ from centerline 84.

The cutting elements 96 may be of any suitable type or manufacture, such as a PDC or TSP cutter, and are oriented to engage the side of the borehole to provide a slight enlargement of a maximum magnitude $\Delta D$ of the borehole beyond the first gage radius cut by the gage cutters 70' at radial distance $D_1$ from the centerline. The contact between the cutting elements 96 of the contact area 88 and the formation lessens the loading on the gage cutters 70', thereby lessening the wear on the gage cutters 70' as drilling continues. The cutting elements 96 of the contact area 88 also assist in removing material from the borehole sidewall and enhance the steerability of the drill bit 50 downhole. The increased borehole diameter achieved through use of the non-axial gage portion 80, which may be characterized as $2\Delta D$ if the bit drills perfectly about centerline 84, also enhances the maneuverability of the drill bit 50 such that if the gage cutters 70' or other cutting elements 70 on the face portion 68 wear down and the drill bit needs replacing, the drill bit 50 can be tripped out of the borehole with relative ease.

As further shown in FIG. 2, the blades 90 of the non-axial gage portion 80 may also bear abrasion-resistant structures, such as tungsten carbide inserts, buttons, or, as shown, wear pads 98, which also aid in the steerability of the drill bit 50 and which facilitate maneuverability of the drill bit 50. Rather than carrying discrete abrasion-resistant structures, non-axial gage portion 80 may have diamond grit embedded in the surface thereof, a diamond film coating thereon, or a layer of hardfacing applied thereto, as known in the art. It can be seen that wear pads 98 or other abrasion-resistant structures may be positioned along those non-contact areas 99 of the non-axial gage portion 80 which, by virtue of the non-axial orientation of the gage, do not contact the formation as readily or as continuously as the contact area 88 of the non-axial gage portion 80. Abrasion-resistant structures in the non-contact areas 99 of the non-axial gage portion 80 may aid in the steerability and maneuverability of the drill bit 50.

Figure 3:
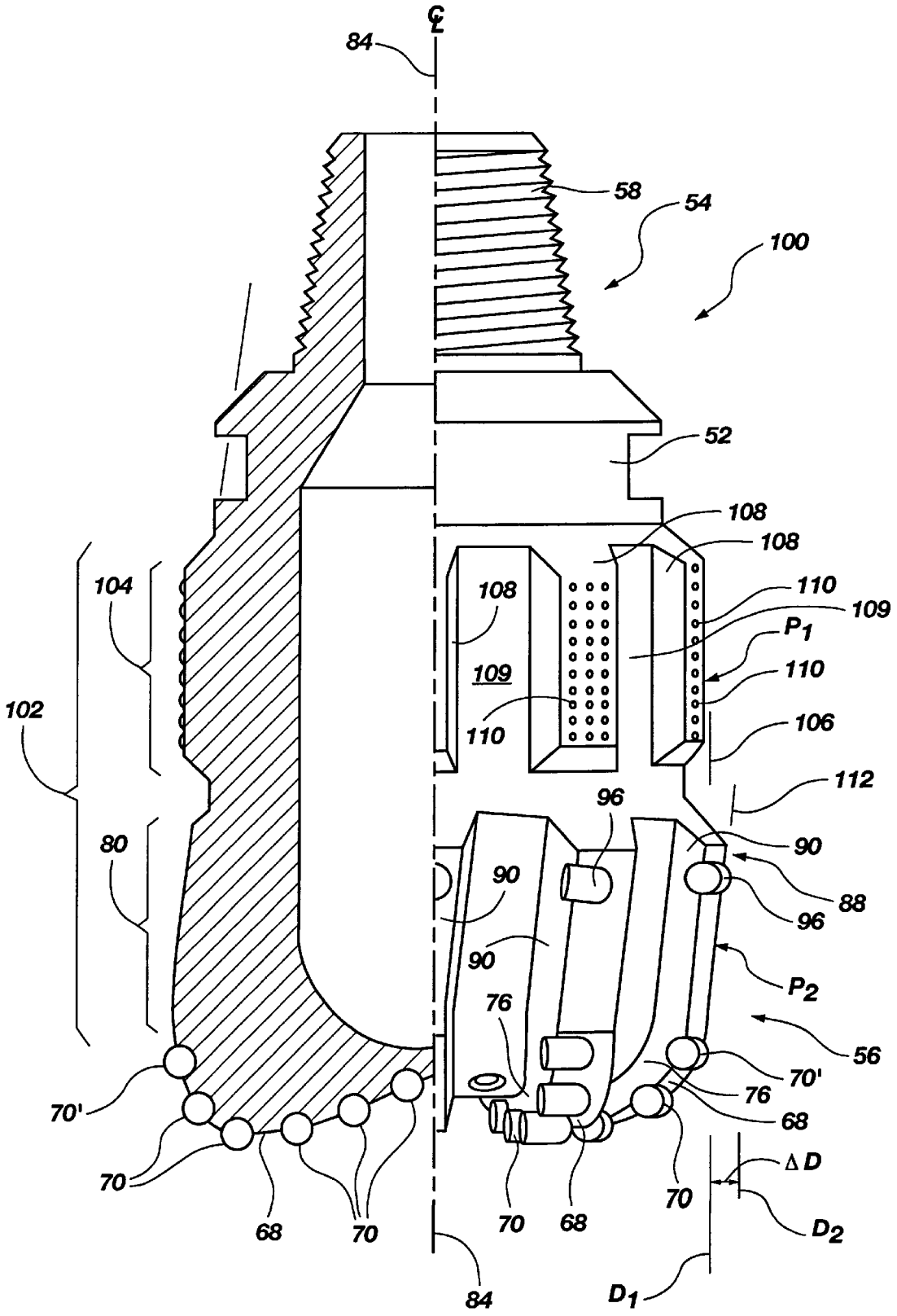
FIG. 3 is a view in elevation of a second embodiment of the invention illustrating a drill bit having a non-axial gage portion positioned above the face portion of the bit body and an axial gage portion positioned above the non-axial gage portion.

FIG. 3 illustrates a second embodiment of the present invention in which the drill bit 100 again comprises a shank portion 54 and a crown portion 56 bearing at least one cutting element 70 on the face portion 68 thereof. The bit body 52 of this embodiment also comprises a gage region 102 which further comprises an axial gage portion 104 and a non-axial gage portion 80. The axial gage portion 104 of gage region 102 presents a peripheral profile $P_1$ which may comprise an outer envelope of a cylindrical surface of revolution 106 oriented parallel to, and concentric with, the centerline 84 of the bit body 52. The axial gage portion 104 may be structured in any conventional manner to provide the peripheral profile $P_1$, one possible configuration being a plurality of blades 108 extending outwardly from the bit body 52 with junk slots 109 being provided therebetween. Some or all of the blades 108 may have cutting elements or abrasion-resistant structures, such as tungsten inserts 110, buttons or wear pads, attached thereto and oriented toward the subterranean formation. The axial gage portion 104 may, in the alternative, be configured without blades.

The non-axial gage portion 80 of the embodiment illustrated in FIG. 3 presents a peripheral profile $P_2$ which lies along an orientational line or plane 112 which is not parallel to the centerline 84 of the bit body 52. Again, the profile $P_2$ may comprise the envelope of a cylindrical surface of revolution about a centerline tilted or canted at an angle to centerline 84 of bit body 52, or be otherwise configured as previously noted herein. The non-axial gage portion 80 may be structured in any suitable manner which presents a profile $P_2$ which is non-parallel or non-axial as shown. One exemplary configuration of the non-axial gage portion 80 is illustrated where a plurality of longitudinally aligned blades 90 is arranged about the bit body 52, a number of such blades 90 being oriented outwardly from the exterior of the bit body 52 to provide a contact area 88 of the non-axial gage portion 80 which engages the borehole. Notably, the non-axial gage portion 80 may be structured without blades 90 and in a manner which provides a contact area 88 for engaging the borehole. In the illustrated embodiment, the contact area 88 of the non-axial gage portion 80, comprising outwardly extending blades 90, is structured with at least one cutting element 96 oriented to engage the borehole. The cutting elements 96 are positioned on the blades 90 at a maximum radial distance $D_2$ from the centerline 84 of the bit body 52 which is slightly greater than the radial distance $D_1$ that the gage cutters 70' are positioned from the centerline 84. While the gage cutters 70' produce the initial gage diameter of the borehole during drilling, the contact of the cutting elements 96 of the nonaxial gage portion 80 produces a slight enlargement of a maximum $2\Delta D$ of the borehole for facilitating maneuverability, steerability and loading on the cutting elements 70, 70'.

Figure 4:
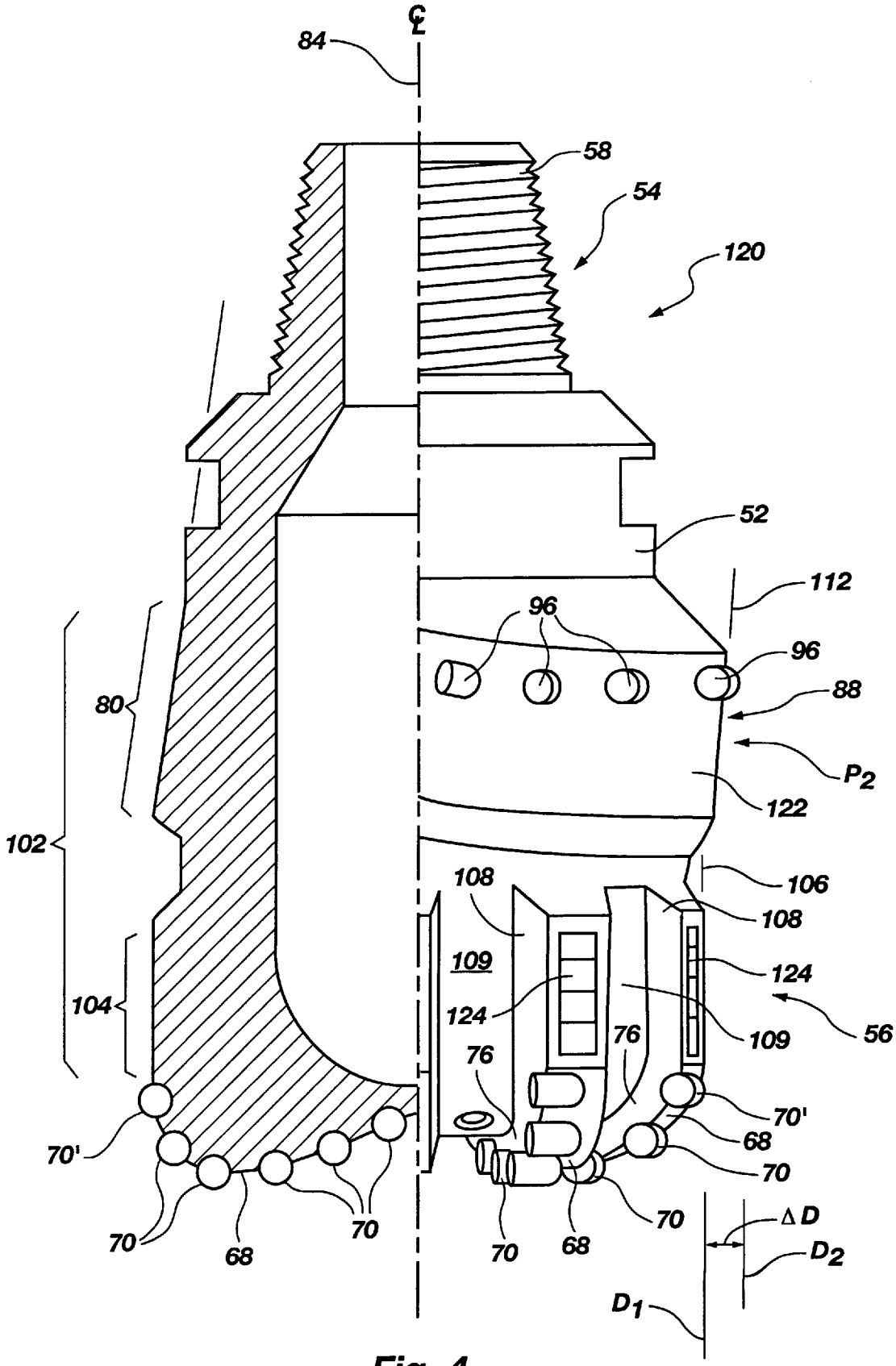
FIG. 4 is a view in elevation of a third embodiment of the invention illustrating a drill bit having an axial gage portion positioned above the face portion of the bit body and a non-axial gage portion positioned above the axial gage portion.

As illustrated in FIG. 3, the non-axial gage portion 80 of the gage region 102 of the drill bit 100 may be located directly above the face portion 68 of the crown portion 56 and extends to the axial gage portion 104. However, the drill bit 120 of the present invention may be alternatively configured as illustrated in FIG. 4 where the gage region 102 of the drill bit 120 comprises an axial gage region 104 located above the face portion 68 of the crown portion 56 of bit body 52 and extends to a non-axial gage region 80 which is positioned adjacent the shank portion 54 of the bit body 52 of drill bit 120. Again, the non-axial gage portion 80 of bit body 52 of the drill bit 120, illustrated in FIG. 4, may be structured in any manner which presents a peripheral profile $P_2$ which is non-parallel to the centerline 84 of the bit body 52 and which further provides a contact area 88 for engaging the borehole.

As shown in FIG. 4, the non-axial gage portion 80 may be configured as a continuous annular land 122 projecting outward from the bit body to provide an outer peripheral profile $P_2$ which lies in a plane 112 that is other than parallel to the centerline 84 of the bit body 52. The cant or tilt of the annular land 122 permits passage of formation debris thereby up the borehole annulus despite the absence of conventional junk slots, although such may be incorporated in annular land 122 to render same circumferentially discontinuous. One portion of the annular land 122 is configured to extend outward from the centerline 84 a sufficient distance to provide a contact area 88 which engages the side of the borehole. The contact area 88 of the non-axial gage portion 80 may be structured with at least, and preferably a plurality of, cutting elements 96 attached to the annular land 122. The cutting elements 96 of the non-axial gage portion 80 are positioned a maximum radial distance $D_2$ from the centerline 84 of the bit body 52 and engage the borehole sidewall to a maximum radial depth $\Delta D$ greater than the gage diameter $D_1$ cut by the gage cutters 70'.

The axial gage portion 104 of the embodiment illustrated in FIG. 4 may be configured in any suitable manner which provides a peripheral profile $P_1$ comprising a cylindrical surface of revolution 106 which is parallel to the centerline 84 of the bit body 52. As shown, the axial gage portion 104 may be configured with a plurality of blades 108 which extends outward from the bit body 52 and may preferably include junk slots 109 positioned between the blades 108 for moving formation chips up and out of the borehole. The blades 108 of the axial gage portion 104 may be continuous with the blades 76 of the face portion 68 or, in the alternative, the blades 108 of the axial gage portion 104 may be discontinuous from and in circumferential alignment or nonalignment with the blades 76 formed on the face portion 68. As illustrated, the blades 108 of the axial gage portion 104 may be configured with attached cutting elements or abrasion-resistant structures, such as wear pads 124, tungsten inserts, or the like.

Figure 5:
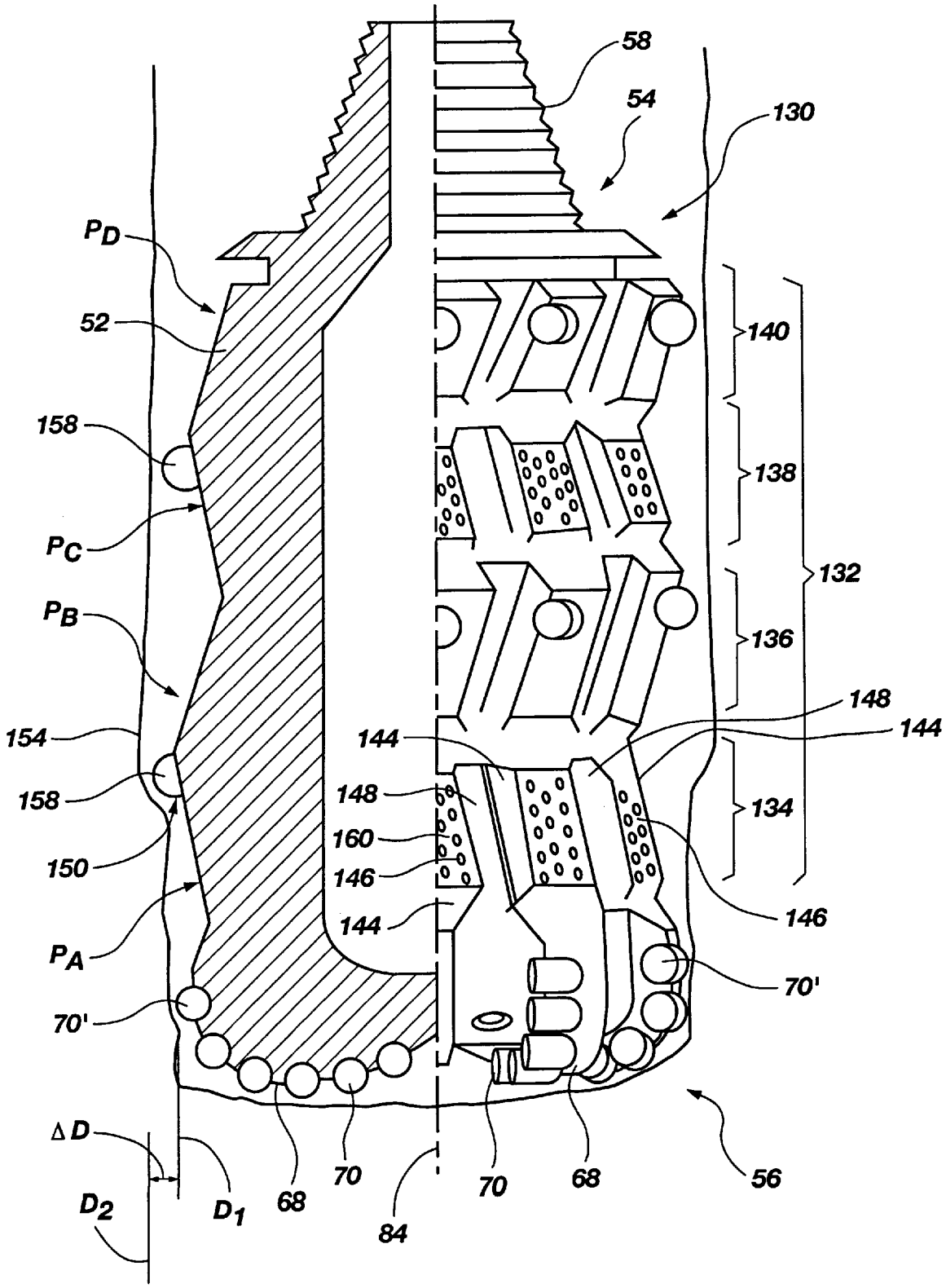
FIG. 5 is a view in elevation of a fourth embodiment of the invention illustrating a drill bit having a plurality of non-axial, substantially linear, longitudinally extending gage subportions.

A fourth embodiment of the drill bit 130 of the present invention is illustrated in FIG. 5 where the gage region 132 of the drill bit 130 comprises a number of non-axial gage subportions 134, 136, 138, 140, each of which presents a peripheral profile $P_A$, $P_B$, $P_C$, $P_D$ which lies at a non-parallel orientation to the centerline 84 of the bit body 52. The peripheral profile of any given non-axial gage subsection may, as illustrated, be oriented at an angle (i.e., not parallel) to the the peripheral profile of any adjacent non-axial gage subportion. Further, the peripheral profile $P_A$, $P_B$, $P_C$, $P_D$ of each non-axial gage subportion 134, 136, 138, 140 is substantially linear and junctions between individual subportions are thus sharply defined.

Considering a single non-axial gage subportion 134 as exemplary of the remaining non-axial gage subportions 136, 138, 140, it can be seen that in this particularly illustrated embodiment, the subportion 134 generally comprises a plurality of blades 144, and the outer face 146 of each blade 144 provides a rather distinct, linear peripheral profile $P_A$ of the subportion 134. Junk slots 148 may preferably be formed between the blades 144 to allow formation chips to flow past the side of bit 130 and subsequently out of the borehole. The blades 144 are oriented non-axially to provide a contact area 150 associated with the subportion 134 which engages the borehole 154 to produce an enlargement of the diameter of the borehole.

As previously described with respect to other embodiments, the contact area 150 of the subportion 134 may be configured with at least one cutting element 158 which is positioned to extend a maximum radial distance $D_2$ from the centerline 84 of the bit body 52 to effectively enlarge the diameter of the borehole 154 by a maximum amount 2ΔD greater than the first gage diameter cut by gage cutters 70' at radial distance $D_1$ on the face portion 68 of the bit body 52. The outer faces 146 of those blades 144 of the subportion 134 which, by virtue of their orientation, do not necessarily contact the borehole 154 may nonetheless be configured with abrasion-resistant structures 160 to lessen wear in the gage region 132. It is understood that the remaining non-axial gage subportions 136, 138, 140 of the drill bit 130 are structured in essentially the same manner as described for non-axial gage subportion 134 in including a non-parallel peripheral profile, a contact area and a cutting element to engage the borehole 154. It is also notable that configuring each non-axial gage subportion 134, 136, 138, 140 with blades is merely one exemplary way to configure the subportions to achieve the required peripheral profile and engagement with the borehole. Many other suitable configurations are available for structuring the gage subportions 134, 136, 138, 140 of the drill bit 130 in accordance with the invention.

Figure 6:
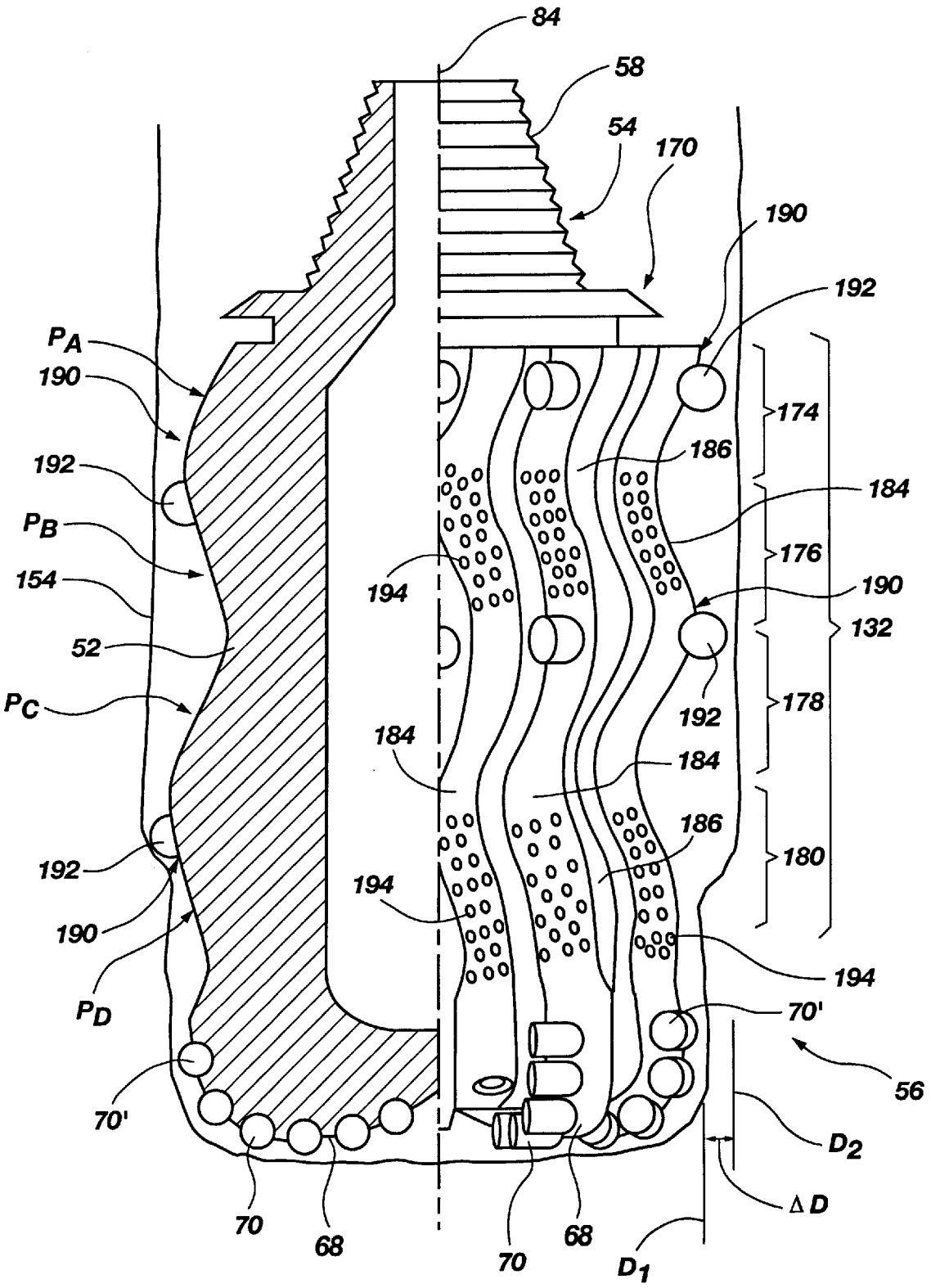
FIG. 6 is a view in elevation of a fifth embodiment of the invention illustrating a drill bit having a plurality of non-axial, substantially non-linear, longitudinally extending gage subportions.
Figure 7A:
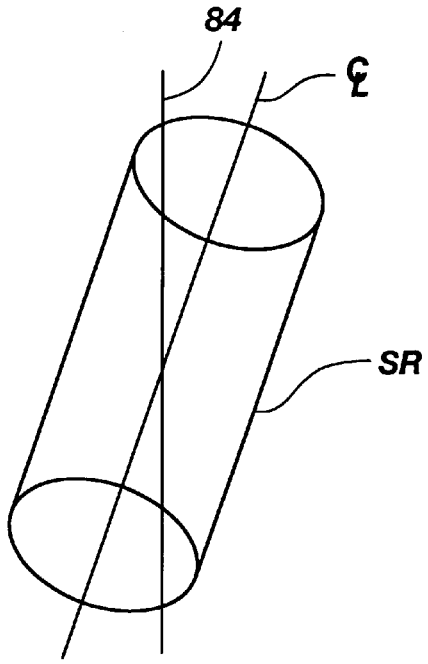
FIG. 7A schematically illustrates one characterization of a non-axial gage portion according to the present invention wherein the peripheral profile of the non-axial gage portion comprises a cylinder of revolution, FIG. 7B schematically illustrates another characterization of a non-axial gage portion according to the present invention wherein the peripheral profile of the non-axial gage portion may be likened to a stack of increasingly laterally offset thin body sections.
Figure 7B:
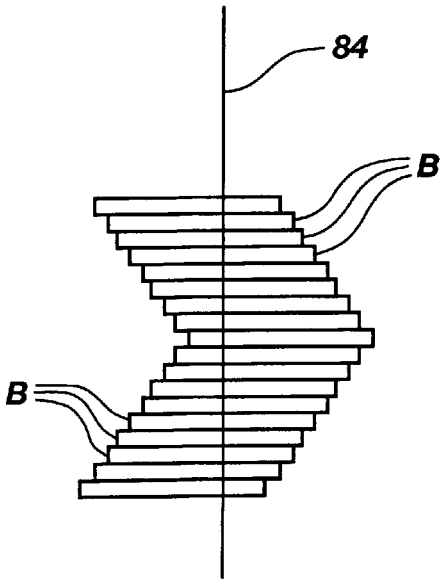
FIG. 7C illustrates a variation of the characterization of FIG. 7B looking downwardly along the centerline of the bit body, wherein the thin body sections are sequentially circumferentially or rotationally offset as they become more laterally offset.
Figure 7C:
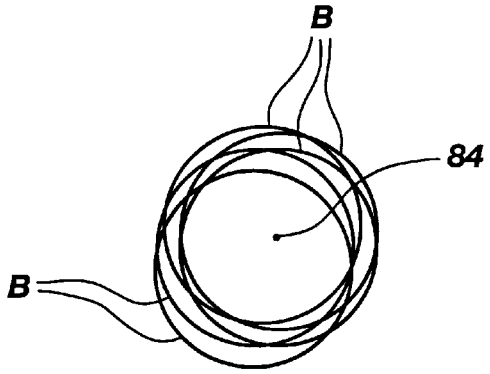

FIG. 6 illustrates a fifth embodiment of the drill bit 170 where the gage region 172 of the drill bit 170 is also comprised of a number of non-axial gage subportions 174, 176, 178, 180 where each of the subportions 174, 176, 178, 180 generally presents a peripheral profile $P_A$, $P_B$, $P_C$, $P_D$ which is not parallel to the centerline 84 of the bit body 52. However, in this embodiment, the peripheral profiles $P_A$, $P_B$, $P_C$, $P_D$ of the subportions 174, 176, 178, 180 are characterized by being substantially non-linear or arcuate, compared to the substantially linear aspect of the subportions 134, 136, 138, 140 illustrated in FIG. 5. The general outer periphery of the bit body 52 may, in fact, be characterized as being curvaceous. One exemplary configuration for achieving a nonlinear peripheral profile $P_A$, $P_B$, $P_C$, $P_D$ in the drill bit 170 is to provide a plurality of continuous, curved blades 184 which extend from the face portion 68 of the crown portion 56 to near the shank portion 54 of the bit body 52. The curved blades 184 may, as shown, generally extend longitudinally along the bit body 52 at the same circumferential locations throughout their respective extents or, alternatively, may extend about the bit body 52 in a generally helical fashion. Junk slots 186 may preferably be formed between adjacent blades 184 to assist in movement of the formation chips from the face portion 68 of the crown portion 56 of drill bit 170. While the blades 184 are illustrated as being continuous, the blades 184 may be discontinuous between the non-axial gage subportions 174, 176, 178, 180.

Each non-axial gage subportion 174, 176, 178, 180 is configured to provide a contact area 190 thereof which engages the borehole 154 to enlarge the diameter of the borehole 154. At least one cutting element 192 is located in each contact area 190 of each non-axial gage subportion 174, 176, 178, 180 and is positioned a maximum radial distance $D_2$ from the centerline 84 of the bit body 52 to enlarge the diameter of the borehole 154 by a maximum amount 2ΔD greater than the gage diameter $D_1$ cut by gage cutters 70' disposed at radial distance $D_1$ from centerline 84 on the crown portion 56 of the bit body 52. Abrasion-resistant structures 194, such as carbide buttons, may be secured to each blade 184, as illustrated.

It should be noted that the embodiments of FIGS. 5 and 6, or any bit according to the invention employing more than one non-axially aligned gage subportion, may also be configured with vertically (i.e., longitudinally) offset subportions being laterally offset or canted other than in diametrically opposing directions, for example by 60 or 90 degree rotational offsets.

The present invention is further characterized by a method of drilling a subterranean formation with a drill bit configured with a non-axial gage portion as previously described. Accordingly, a drill bit having a bit face bearing cutting elements and at least one non-axial gage portion is used to drill a subterranean formation, the gage cutting elements of the bit face cutting the initial gage diameter of the borehole while cutting elements attached to the non-axial gage portion of the drill bit engage the side of the borehole to cut a depth greater than the gage diameter formed by the gage cutters on the bit face. The engagement of the non-axial gage portion with the side of the borehole reduces the loading on the gage cutters, provides enhanced steerability to the drill bit, and provides an enlarged diameter of the borehole to facilitate maneuvering and tripping the drill bit out of the hole.

The apparatus of the present invention provides structure for drilling a subterranean formation which facilitates maneuverability, steerability and which lessens loading on the cutting elements at the periphery of the bit face. The particular configuration of the drill bit may be dictated by the conditions and parameters of the formation being drilled. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims. In one, non-limiting example, it is contemplated as within the scope of the invention that the non-axial gage portion of the invention may be configured as a separate structure or sub, such as a tubular body having a bore therethrough and threaded connections at each end thereof, to which a drill string above and conventional drill bit below may be secured. In another such example, a bit may be configured to receive alternative non-axial gage portions in order to provide for different borehole enlargement capabilities and differently configured non-axial gage portions, according to the invention. In yet another example, multiple axial and non-axial gage portions may be alternated, or several adjacent non-axial gage portions placed with an axial gage portion thereovet or thereunder. In still another example, a roller cone bit may be formed with one or more non-axial gage portions, according to the present invention, or a roller cone bit employed in tandem with a sub thereover incorporating the present invention.

What is claimed is:

1. A rotary drilling structure for drilling a borehole in a subterranean formation, comprising:

a body having a centerline and at least one cutting element at a periphery thereof being positioned to cut a borehole in a formation to a first gage diameter;

at least one non-axial gage portion on said body defining a peripheral profile exhibiting a substantially constant cross-sectional area transverse to said centerline throughout at least a portion of a longitudinal extent of said at least one non-axial gage portion and oriented along at least one direction disposed at an acute angle to said centerline; and at least one contact area located on said at least one non-axial gage portion at a position radially beyond said first gage diameter and bearing at least one cutting element thereon positioned for engagement with said formation.

2. The rotary drilling structure of claim 1, further comprising at least one axial gage portion having a peripheral profile oriented substantially parallel to said centerline.

3. The rotary drilling structure of claim 2, wherein said at least one axial gage portion extends from proximate a lower portion of said body toward said at least one non-axial gage portion.

4. The rotary drilling structure of claim 2, wherein said at least one non-axial gage portion extends from proximate a lower portion of said body toward said at least one axial gage portion.

5. The rotary drilling structure of claim 1, wherein said at least one non-axial gage portion comprises a plurality of non-axial gage subportions, each of said plurality of non-axial gage subportions being oriented at an angle to said centerline and including at least one contact area located thereon radially beyond the first gage diameter and bearing at least one cutting element thereon positioned for engagement with the formation.

6. The rotary drilling structure of claim 5, wherein at least some of said plurality of non-axial gage subportions are oriented at similar angles to the centerline but in differing circumferential orientations.

7. The rotary drilling structure of claim 5, wherein at least some of said plurality of non-axial gage subportions have peripheral profiles oriented at different angles to the centerline.

8. The rotary drilling structure of claim 6, wherein at least one of said plurality of non-axial gage subportions defines a peripheral profile extending substantially linearly in a longitudinal direction.

9. The rotary drilling structure of claim 6, wherein at least one of said plurality of non-axial gage subportions defines a profile extending substantially non-linearly in a longitudinal direction.

10. The rotary drilling structure of claim 1, wherein said at least one non-axial gage portion includes a peripheral profile substantially defined by a cylindrical surface of revolution about a centerline disposed at an angle to the body centerline.

11. The rotary drilling structure of claim 10, wherein the cylindrical surface of revolution centerline intersects the body centerline.

12. The rotary drilling structure of claim 1, wherein said at least one non-axial gage portion comprises a plurality of blades defining junk slots therebetween.

13. The rotary drilling structure of claim 1, wherein said at least one non-axial gage portion comprises a substantially annular land extending about said body.

14. The rotary drilling structure of claim 1, wherein said rotary drilling structure is selected from a group comprising a rotary drag bit, a roller cone bit and a sub.

15. The rotary drilling structure of claim 1, wherein said at least one non-axial gage portion defines a peripheral profile extending substantially linearly in a longitudinal direction.

16. The rotary drilling structure of claim 1, wherein said at least one non-axial gage portion defines a profile extending substantially non-linearly in a longitudinal direction.

17. A rotary drill bit for drilling a borehole in a subterranean formation, comprising:

a bit body having a centerline, a crown portion including a face and a shank portion;

said face having at least one cutting element at a periphery thereof being positioned to cut a borehole in a formation to a first gage diameter;

at least one non-axial gage portion on said bit body defining a peripheral profile exhibiting a substantially constant cross-sectional area transverse to said centerline throughout at least a portion of a longitudinal extent of said at least one non-axial gage portion and oriented along at least one direction disposed at an acute angle to said centerline; and at least one contact area located on said at least one non-axial gage portion radially beyond the first gage diameter and bearing at least one cutting element thereon positioned for engagement with the formation.

18. The rotary drill bit of claim 17, wherein said face has attached thereto a plurality of cutting elements oriented to engage and cut a bottom of the borehole.

19. The rotary drill bit of claim 17, wherein said face includes a gage defining portion having a plurality of gage cutting elements attached thereto for cutting the first gage diameter.

20. The rotary drill bit of claim 17, wherein said at least one non-axial gage portion is configured with a plurality of circumferentially spaced-apart blades extending generally radially from said bit body.

21. The rotary drill bit of claim 20, wherein said blades of said plurality are configured to be abrasion-resistant on radially outer surfaces thereof.

22. The rotary drill bit of claim 20, wherein said plurality of blades is oriented substantially longitudinally along said bit body in alignment with said centerline.

23. The rotary drill bit of claim 17, wherein said at least one non-axial gage portion is configured with a raised annular land.

24. The rotary drill bit of claim 23, wherein at least some radially outer surfaces of said raised annular land are configured for abrasion-resistance.

25. The rotary drill bit of claim 17, further comprising at least one axial gage portion positioned on said bit body.

26. The rotary drill bit of claim 25, wherein said at least one axial gage portion further comprises a plurality of circumferentially spaced-apart blades extending generally radially from said bit body.

27. The rotary drill bit of claim 17, wherein said at least one non-axial gage portion comprises a plurality of longitudinally superimposed non-axial gage subportions, each of said plurality of non-axial gage subportions comprising a plurality of blades extending from said bit body.

28. The rotary drill bit of claim 27, wherein each of said plurality of blades of said plurality of non-axial gage subportions is coextensive with a blade of an adjacent non-axial gage subportion.

29. The rotary drill bit of claim 17, wherein said at least one non-axial gage portion comprises a plurality of non-axial gage subportions, each of said plurality of non-axial gage subportions being oriented at an angle to said centerline and including at least one contact area located thereon radially beyond the first gage diameter and bearing at least one cutting element thereon positioned for engagement with the formation.

30. The rotary drill bit of claim 29, wherein at least some of said plurality of non-axial gage subportions are oriented at similar angles to the centerline but in differing circumferential orientations.

31. The rotary drill bit of claim 29, wherein at least some of said plurality of non-axial gage subportions have peripheral profiles oriented at different angles to the centerline.

32. The rotary drill bit of claim 29, wherein at least one of said plurality of non-axial gage subportions defines a peripheral profile extending substantially linearly in a longitudinal direction.

33. The rotary drill bit of claim 29, wherein at least one of said plurality of non-axial gage subportions defines a profile extending substantially non-linearly in a longitudinal direction.

34. The rotary drill bit of claim 17, wherein said at least one non-axial gage portion includes a peripheral profile substantially defined by a cylindrical surface of revolution about a centerline disposed at an angle to the body centerline.

35. The rotary drill bit of claim 34, wherein the cylindrical surface of revolution centerline intersects the body centerline.

36. The rotary drill bit of claim 17, wherein said at least one non-axial gage portion comprises a plurality of blades defining junk slots therebetween.

37. The rotary drill bit of claim 17, wherein said at least one non-axial gage portion comprises a substantially annular land extending about said body.

38. The rotary drill bit of claim 17, wherein said rotary drill bit is selected from a group comprising a rotary drag bit and a roller cone bit.

39. The rotary drill bit of claim 17, wherein said at least one non-axial gage portion defines a peripheral profile extending substantially linearly in a longitudinal direction.

40. The rotary drill bit of claim 17, wherein said at least one non-axial gage portion defines a profile extending substantially non-linearly in a longitudinal direction.

* * * * *

UNITED STATES PATENT AND TRADEMARK OFFICE

CERTIFICATE OF CORRECTION

PATENT NO. : 6,206,117 B1 
DATED : March 27, 2001
INVENTOR(S) : Gordon A. Tibbitts and James A. Norris It is certified that error appears in the above-identified patent and that said Letters Patent is hereby corrected as shown below:

Column 6,
Line 61, change "carmot" to -- cannot --

Column 8,
Line 32, after "centerline" and before the period insert -- 84 --

Signed and Sealed this

Twenty-third Day of September, 2003

JAMES E. ROGAN
*Director of the United States Patent and Trademark Office*